United States Patent [19]

Schonath

[11] Patent Number: 4,934,951

[45] Date of Patent: Jun. 19, 1990

[54] HOLDER FOR SMALL INCANDESCENT LIGHT BULBS

[75] Inventor: Andreas Schonath, Oberleiterbach, Fed. Rep. of Germany

[73] Assignee: Paul Albrecht, Bamburg, Fed. Rep. of Germany

[21] Appl. No.: 239,142

[22] Filed: Aug. 31, 1988

[30] Foreign Application Priority Data

Sep. 4, 1987 [DE] Fed. Rep. of Germany ..... 3729622

[51] Int. Cl.[5] ..... H01K 1/46; H01R 9/09

[52] U.S. Cl. ..... 439/86; 313/51; 439/57; 439/547

[58] Field of Search ..... 439/57, 86, 547, 554, 439/558, 694; 313/49, 50, 51

[56] References Cited

U.S. PATENT DOCUMENTS 3,864,001 2/1975 Millet ..... 439/744 X
4,299,430 11/1981 Baba et al. ..... 439/57
4,468,585 8/1984 Beyland et al. ..... 439/57 X

FOREIGN PATENT DOCUMENTS 2810402 1/1979 Fed. Rep. of Germany ..... 313/49
1488874 10/1977 United Kingdom ..... 439/86

*Primary Examiner*—Z. R. Bilinsky
*Attorney, Agent, or Firm*—Jordan and Hamburg

[57] ABSTRACT

A holder for a small incandescent light bulb for the removable insertion in a plate opening, the holder being mounted mechanically and electrical contact with the contact areas of the plate being produced by two electrically conducting contacting parts that are connected to the light bulb connection wires, with the proviso that the electrically conducting contacting parts comprise an electrically conductive plastic, especially a polyester with embedded carbon fibers.

12 Claims, 1 Drawing Sheet

HOLDER FOR SMALL INCANDESCENT LIGHT BULBS

The invention is directed to a holder for a small incandescent light bulb for the removable insertion in a plate opening. Two electrically conductive contacting parts of the holder, connected with the light bulb connection wires, form the mechanical holding device and produce the electrical contact with the contact areas of the plate.

In all previous holders, irrespective of the details of the design of the mechanical and also the electrically contacting connection on the plate, the contacting parts basically consist of metal, that is, not only do such metal parts, which are exceptionally tiny for small electrical incandescent light bulbs, have to be manufactured, but their assembly, that is, the connection of these metal parts with the light bulb connection wires, on the one hand, and the connection of the contacting parts with the holder itself, is very intricate.

To eliminate these difficulties, provisions are made pursuant to the present invention that the electrically conducting contacting parts comprise electrically conductive plastic, especially a polyester with embedded carbon fibers.

As a result of the inventive development, the electrical contacting parts can be manufactured very simply by injection molding. This facilitates appreciably not only the manufacture of the parts themselves, but also the above-addressed assembly.

Not only is it possible to gate the electrically conducting parts directly on the light bulb connection wires, it is even conceivable, to encapsulate the small incandescent light bulb in an injection molding mold in a 2-step injection molding process first of all with the holder, leaving the light bulb electrical connection wires free, and then, in a second injection molding process in the holder recesses, with the conductive plastic so as to make contact with the light bulb connection wires. By using appropriate glass for the bulb section of the small incandescent light bulbs, which are also able to cope with high temperatures and especially also tem-Perature gradients, as well as by selectively cooling the holder in the immediate area of contact with the glass bulb, as well as finally transferring the incandescent light bulbs to the injection molding mold after preheating to the processing temperature of the plastics, it can be accomplished without difficulty that the direct 2-step encapsulation can take place without damage to the glass bulb.

Aside from this—more particularly for special shapes or if the intended number of pieces is not too large—it is also possible either to gate only the contacting parts to the light bulb connection wires or to connect the light bulb connection wires subsequently with the contacting parts produced by injection molding. For this purpose, boreholes for inserting the light bulb wires are provided in the injection molded contacting parts made from electrically conductive plastic. The final anchoring is then accomplished very simply with the help of an electric contact glue. It is hardly possible to drill such boreholes in the leaf-spring contacts previously been used.

Aside form the simple embodiments of holders for small incandescent light bulbs, in which axially spaced metal pins or metal tabs are used for clamping to and contacting with the plate, holders with two spaced radial projections encompassing the plate with a clamping action from above and below and at the same time making contact with its contact areas have become known in recent times. With such arrangements, the electrically conducting contacting parts shall form, pursuant to the invention, at least one of these projections. The embodiments, in which both projections are formed by the electrical contacting part, have the advantage that electric contact can be made with the contact areas on the upper side and the underside of the plate. In a refinement of the invention, this is possible most simply by constructing the contacting parts in the shape of a U. It does not matter whether the contacting parts are prefabricated as such U-shaped components and connected with the actual holder by encapsulation or by insertion into appropriate, grooves diametrically opposed to one another.

Finally, it is also within the scope of the invention to provide a holder as described above with at least one ring flange lying opposite one of the projections at a distance equal to the thickness of the plate, with at at least one spring tab, which is bent towards the outside and which, on being twisted into the contacting position, locks into the lateral enlargements of the plate, which serve for inserting the projections.

Further advantages, characteristics and details of the invention arise out of the following description of an example of the operation as well as from the accompanying drawing.

DESCRIPTION OF THE PREFERRED EMBODIMENTS

Figure 1:
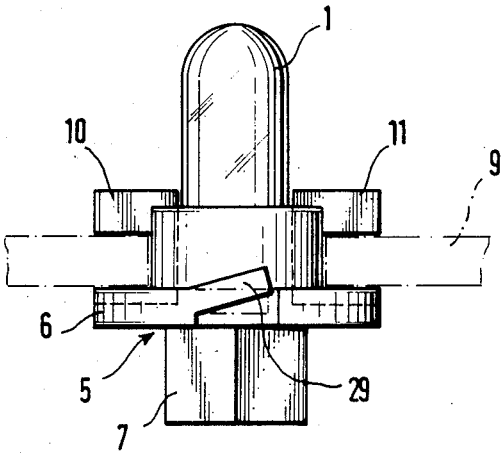
FIG. 1 is a side view of inventive small incandescent light bulb which is provided with a holder.
Figure 4:
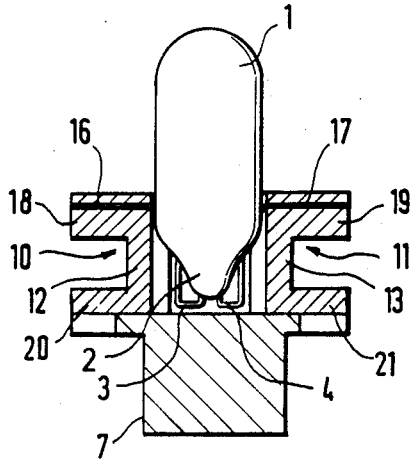
FIG. 4 is a sectional view through the arrangement of FIG. 1.
Figure 2:
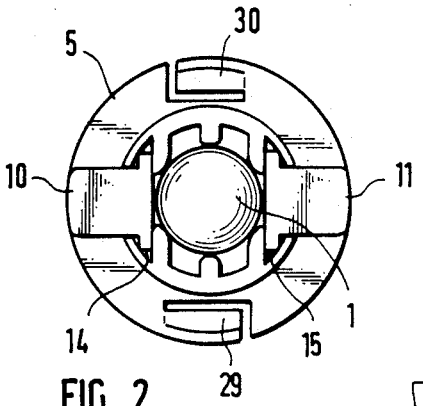
FIG. 2 is a plan view of the arrangement of FIG. 1.
Figure 3:
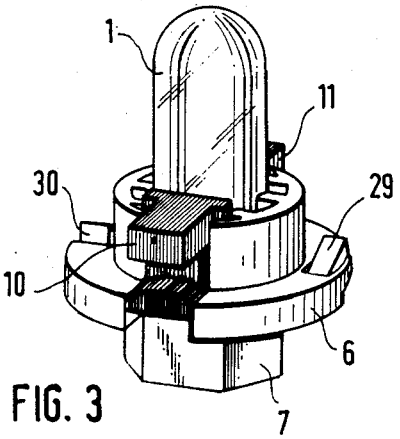
FIG. 3 is a perspective view of the small incandescent light bulb.

A small incandescent light bulb with a glass bulb 1 and two conductor connection wires 3 and 4 coming out of the sealed, lower end section 2 is held in a holder 5, which has a cylindrical mounting for the glass bulb 1 and a handle 6 with preferably a noncircular cross section and which is separated from the glass bulb 1 by a ring flange 7, as described in greater detail below. With the help of this handle 7, the light bulb, connected with the holder, can be inserted through an opening 8 of a plate 9, preferably a printed circuit or the like, and, by twisting 90°, locked into the inserted holder while also producing the electrical contact. For this purpose, the conductor connection wires 3 and 4 are connected pursuant to the invention with electrically conducting contact parts 10 and 11, which are formed as U-shaped injection molded parts from conductive plastic, especially polyester with embedded carbon fibers. The electrically conducting contact parts 10 and 11 are inserted with their base legs 12, 13, which are T-shaped in cross section, into appropriately undercut longitudinal grooves 14 and 15 of the cylindrical mounting 5 of the holder. The electrical connection wires 3 and 4 are connected with the electrically conducting contact parts 10 and 11, which are injection molded from a conductive plastic, either by gating the conductor wires or by inserting these conductor wires into boreholes 16, 17 and anchoring the wire ends in these boreholes with the help of a contact adhesive or the like. In any case, it is easier to make this connection than the soldered connection of such wires to the previously used, tiny, electrically conducting contacting parts, which are constructed as a bent leaf spring. Moreover, producing the inventive injection molded contacting parts 10 and 11 from conductive plastic by injection molding is also significantly simpler than bending the leaf spring contacts. Obviously, the contacting parts 10 and 11 are also locked in the grooves 14 and 15, for example, with the help of a glue.

Figure 5:
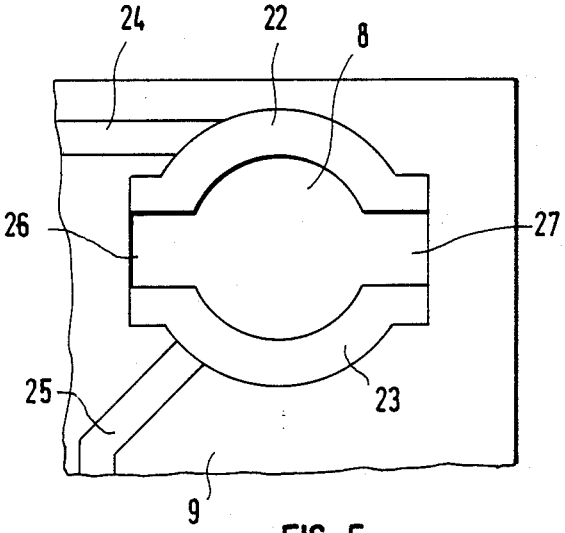
FIG. 5 is a plan view of the plate with the opening and the electrical contacting areas for the contacting parts of the holder.

The upper legs 18 and 19 of the electrical contacting parts 10 and 11 are disposed at a distance corresponding to the thickness of the plate 9 from the lower legs 20 and 21, which are embedded flush with the ring flange 6. The holder is to be inserted in the recess 8 of plate 9. As can be seen from FIG. 1, the upper contacting legs 18 and 19 overlap the upper side of plate 9, while the other legs 20, 21 lie against the underside. With this, the possibility exists of making contact with the contact areas on the upper side as well as on the underside of the plate. In FIG. 5, two contact areas 24 and 25 are schematically indicated, which are connected by semicircular contact strips 22 and 23 and lead to the actual wiring of the plate. Legs 18 and 19 of contacting parts 10, 11 are pushed through enlargements 26 and 27 of recess 8, after which the holder with the small incandescent light bulb held therein is twisted 90°, so that the legs 18, 19 make electrical contact with the contact areas 22, 23.

At the same time, after the small incandescent light bulb is twisted through 90°, two spring-loaded contacting tabs 29, 30, which are bent towards the outside and were initially pressed into the plane of the ring flange 6, lock into the enlargements 26 and 27 and thus prevent the holder turning back automatically and falling out of recess 8.

The invention is not limited to the examples of the operation shown. Aside from the possibility of using the electrically conducting contacting parts, made from a conductive plastic by injection molding, also for other small incandescent light bulb holders of different construction, for which only contacting pins that project downwards are provided, it would also be possible to gate the electrically conducting contact parts directly by a 2-step injection molding process in appropriate recesses of the actual holder 5, into which the the electrical connection wires 3,4 protrude, so that, simultaneously with the gating of this electrically conductive plastic, they are embedded in this plastic, thus making electrical contact.

I claim:

1. A holder for a small incandescent light bulb in which the holder is removably insertable in a plate opening having electrical contact areas, said light bulb having electrical contact means, said holder comprising a main holder part and electrical conducting contacting parts made of an electrically conductive plastic material, supporting means on said contacting parts for supporting said light bulb on said contacting parts and providing contact between said electrical contact means of said light bulb and contacting parts, mounting means on said main holder part and on said contacting parts for mounting said contacting parts on said main holder part, said mounting means comprising encapsulation of said contacting parts onto said main holder part, said contacting parts having engageable means clampingly engageable with said plate opening and with said electrical contact areas to mechanically support the holder in said plate opening while providing electrical contact between said electrical contact areas and said contacting parts.

2. A holder according to claim 1, wherein said plastic material is a polyester embedded with carbon fibers.

3. A holder according to claim 1, wherein said mounting means comprises undercut grooves in said main body part.

4. A holder according to claim 3, wherein there are two of said undercut grooves diametrically opposite one another.

5. A holder according to claim 1, wherein there are two of said contacting parts each having a generally U-shaped configuration having two spaced projections, said plate opening being part of a plate having a plate edge portion disposed about said plate opening, said plate edge portion being received between said two spaced projections.

6. A holder according to claim 5, wherein said plate edge portion includes said electrical contact area, said plate edge portion being clampingly received between said two spaced leg portions while electrical contact is made between said electrical contact area and at least one of said two leg portions.

7. A holder according to claim 5, wherein said main holder part has a ring flange juxtaposed to one of said projections of each contacting part and spaced from the other of said projections of each contacting part a distance substantially equal of the thickness of said plate, and spring tabs on said ring flange for locking said holder in said plate opening.

8. A holder according to claim 7, wherein said plate opening has lateral enlargements or receiving said contact parts during initial insertion of said holder in said plate opening, said holder being partially rotated after said initial insertion to a locked position in which said contact parts are displaced from said lateral enlargements.

9. A holder according to claim 6, wherein said spring tabs are received in said lateral enlargements when said holder has been rotated to said locked position.

10. A holder according to claim 1, wherein there are two of said contacting parts each comprising two spaced projections extending in a generally radial direction.

11. A holder according to claim 1, wherein said supporting means comprises encapsulation of said contacting parts onto said light bulb about said electrical contact means of said light bulb.

12. A holder according to claim 1, wherein said main holder part is formed in an injection mold about said light bulb which is disposed in said mold, said contacting parts being formed in said mold to encapsulate said light bulb.

* * * * *